United States Patent [19]

George

[11] 3,942,271

[45] Mar. 9, 1976

[54] BACKHOE ATTACHMENT

[76] Inventor: Anthony Joseph George, 2415 Nicholby Drive, Limestone Gardens, Wilmington, Del. 19808

[22] Filed: July 8, 1974

[21] Appl. No.: 486,362

[52] U.S. Cl...... 37/117.5; 37/141 R; 56/400.05; 172/249; 172/719; 214/145 R; 294/51; 403/379

[51] Int. Cl.[2].... E02F 3/76; E02F 3/81; F16B 21/10

[58] Field of Search ..... 37/141 R, 141 T, 142 R, 37/142 A, 117.5, DIG. 3; 172/249, 719, 753, 762, 777; 56/400.04, 400.05; 294/51, 59; 403/315, 319, 379; 214/145

[56] References Cited

UNITED STATES PATENTS

| | | | |
|---|---|---|---|
| 596,120 | 12/1897 | Oveson | 294/51 |
| 707,948 | 8/1902 | Spillane | 294/51 |
| 1,031,958 | 7/1912 | Osternd | 294/51 |
| 1,339,357 | 5/1920 | Kopriva | 403/379 X |
| 1,607,037 | 11/1926 | Barnes | 56/400.04 |
| 2,138,150 | 11/1938 | Flynn et al. | 172/753 |
| 2,285,039 | 6/1942 | Lowe | 37/141 R |
| 2,644,251 | 7/1953 | Smith | 37/117.5 |
| 2,780,976 | 2/1957 | Koering | 56/400.04 |
| 2,962,821 | 12/1960 | Peitl | 37/141 R X |
| 3,043,032 | 7/1962 | Discenza | 37/117.5 |
| 3,160,967 | 12/1964 | Nichols | 37/141 T |
| 3,181,256 | 5/1965 | Discenza | 37/117.5 |
| 3,469,330 | 9/1969 | Hood et al. | 37/117.5 |
| 3,523,380 | 8/1970 | Bolyard et al. | 37/141 R |
| 3,765,109 | 10/1973 | Daviduke | 37/141 R |

*Primary Examiner*—Edgar S. Burr
*Assistant Examiner*—Steven A. Bratlie
*Attorney, Agent, or Firm*—C. Walter Mortenson

[57] ABSTRACT

A housing having a V-shaped cross-section is adapted to be positioned over the teeth of a backhoe bucket. An earth moving blade is secured to the lowermost portion of the housing. Lugs are secured to the inside surfaces of adjoining teeth of the backhoe bucket. A retaining bar is inserted through apertures formed in the front and back faces of the housing to engage the lugs between the teeth and thereby retain the receptacle on the tooth portion of the backhoe to permit earth moving and grading operations.

7 Claims, 7 Drawing Figures

BACKHOE ATTACHMENT

BACKGROUND OF THE INVENTION

This invention relates to a removable attachment for use in earth moving operations.

Over the years many different earth moving attachments have been devised and designed for use with both backhoe buckets and shovel buckets. The primary purpose of all of this effort has been an attachment that can be secured quickly and easily to the bucket portion of a backhoe or other power shovel to permit the backhoe to be used for earth moving or grading operations as well as the normal digging and trenching operations for which the backhoe is specifically designed. While simplicity and ease of attachment have been the claimed virtues of many of these prior art devices, in fact, this has not been the case. They have required bolting, precision adjustment, exacting matching of parts and in some cases have lacked sufficient strength to permit much more than their superficial use for earth leveling and/or grading operations.

Accordingly, it is an object of this invention to provide an improved earth grading attachment for use with backhoe buckets.

A further object of this invention is to provide an improved earth grading attachment for backhoe buckets that is simply and easily attached.

A still further object of this invention is to provide an improved low cost earth grading attachment for a backhoe bucket.

BRIEF DESCRIPTION OF THE INVENTION

In one embodiment of this invention, an earth moving attachment is designed for use with the bucket of a piece of earth moving equipment. The attachment includes a housing adapted to receive the teeth of the bucket of a piece of earth moving equipment, retaining lugs secured to adjacent sides of adjoining ones of at least a pair of the teeth, said housing defining an aperture in opposing faces of the housing, a removable retaining bar adapted to pass through the apertures to engage said adjoining teeth and lugs, thereby to secure the housing to the bucket teeth, and a blade secured to the housing.

In a preferred embodiment of the invention the retaining bar has one end enlarged and the other end adapted to receive a spring clip thereby to secure the retaining bar in position relative to said housing. Preferably, the retaining bar is rectangular in cross-section to facilitate its engaging the retaining lugs on the teeth of the bucket.

In still another embodiment of the invention the blade is inserted in a slot formed in the normally lower portion of the housing. The blade is secured to the housing by retaining bars in much the same manner as the housing is secured to the bucket teeth, i.e., by the use of retaining bars inserted through aligned apertures in the housing and blade.

BRIEF DESCRIPTION OF THE DRAWINGS

The novel features that are considered characteristic of this invention are set forth with particularity in the appended claims. The invention, itself, however both as to its organization and method, as well as additional objects and advantages thereof will best be understood from the following description when read in connection with the accompanying drawings in which:

DESCRIPTION OF THE PREFERRED EMBODIMENTS

Figure 1:
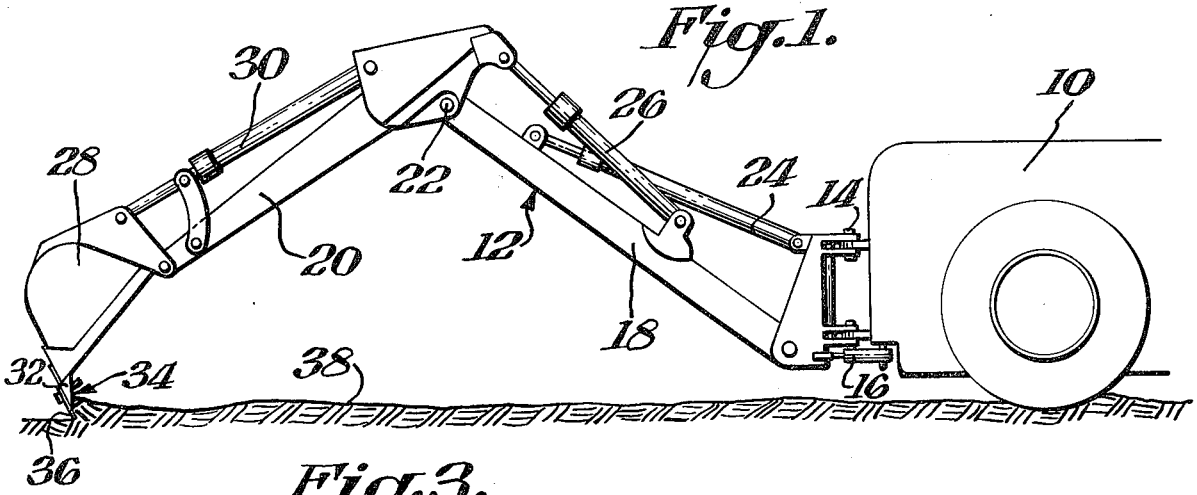
FIG. 1 is a partial side elevation view of a backhoe illustrating a typical usage of the earth moving attachment of this invention.
Figure 3:
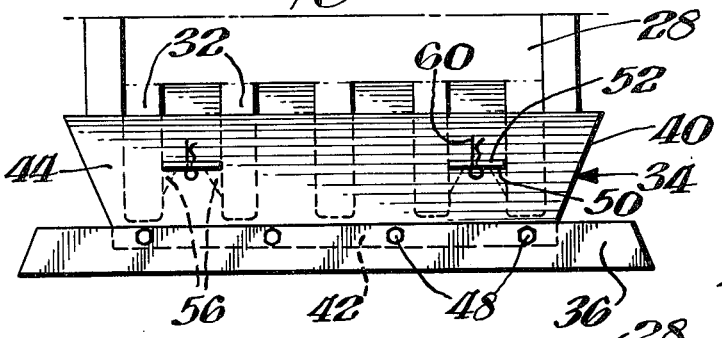
FIG. 3 is a back elevation view of the earth moving attachment illustrated in FIG. 2.
Figure 4:
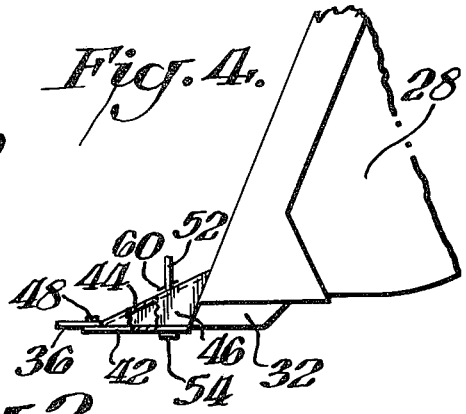
FIG. 4 is a side elevation view of the earth moving attachment illustrated in FIG. 2.

The illustration of FIG. 1 depicts the environment in which this invention is typically used. In FIG. 1 there is shown a portion of a vehicle 10, which is depicted as a tractor-type vehicle, to which a backhoe 12 is pivotally mounted as at 14 to pivot in a horizontal plane. Pivoting in a horizontal plane is accomplished by a hydraulic actuator 16 secured to the vehicle 10 and the backhoe 12 in accordance with well-known techniques. The backhoe itself is conventional and includes a stick 18 and boom 20 which are pivotally secured to each other as at 22. The boom 20 is raised and lowered by a hydraulic actuator 26 secured to the upper portion of the stick 18. A digging bucket 28 is pivotally mounted to the free end of the boom 20 and its movement is controlled by a hydraulic actuator 30 cooperating with the actuator 26. The end or lowermost portion of the bucket 28 has conventional teeth 32 secured thereon to aid in a digging or trenching operation. The several teeth 32 are secured to the lower edge of the bucket as seen most clearly in FIG. 3. Other backhoes than the one depicted may be used with this invention. The one depicted is merely exemplary of a backhoe with which the invention may find use since the invention is adapted for use with any bucket-type earth moving or handling device having teeth.

In accordance with this invention an earth moving or leveling attachment 34, having a cutting blade 36 attached thereto, permits earth or similar material 38 to be graded and leveled utilizing the backhoe bucket itself without requiring, in most cases, the transportation of a bulldozer or other similar grading and leveling vehicle to the construction site.

Figure 5:
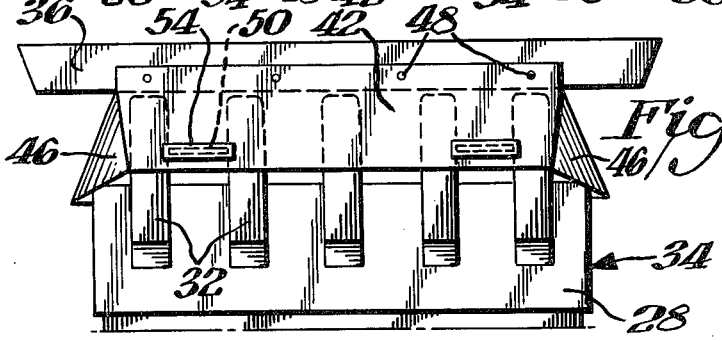
FIG. 5 is a front elevation view of the earth moving attachment illustrated in FIG. 2.

The earth moving attachment 34 includes a receptacle or housing 40 which has a pair of front and back face plates 42 and 44, respectively, and end pieces 46 (FIG. 5) which form the housing 40. The housing has a generally V-shaped longitudinal cross-section adapted to fit over and generally conform to the shape of the teeth 32. The cutting blade 36 is secured or attached as by bolts 48 to the front face plates 42 of the housing 40. The housing itself preferably is formed of metal plate stock and may be welded together for strength.

Mating or aligned apertures 50 are formed in the front and back face plates 42, 44 of the housing 40. These apertures are in mating alignment to permit the introduction or insertion of a retaining bar 52 therethrough. Preferably, two bars are used, one adapted to engage either side of the bucket. These retaining bars preferably have a rectangular cross-section and an enlarged rear or head end 54, as is seen most clearly in FIG. 5, to prevent the bar from sliding completely through the apertures 50. These retaining bars are adapted to engage pairs of lugs 56 formed on the inside faces of adjoining teeth 58 of the bucket 28. These lugs 56 may be welded to the inside faces of the adjoining teeth. A single lug may be used, but two are preferred.

Figure 2:
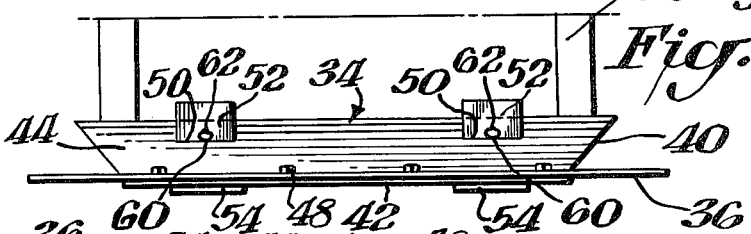
FIG. 2 is a bottom view of the earth moving attachment constructed in accordance with this invention and secured to the bucket of the backhoe illustrated in FIG. 1, the bucket being depicted in phantom.

The remaining ends of the retaining bars 52 have orifices 62 (FIG. 2) formed therein to permit the introduction of spring-like, U-shaped, locking clips 60 therethrough. Locking clips 60 are introduced through apertures 62 (FIG. 2) formed in the retaining bar 52 for this purpose.

To attach the housing 40 to the teeth of the backhoe bucket, one merely slides or fits the housing over the tooth portion of the bucket 28. The two retaining bars 52 are inserted through the apertures in the face plates 42, 44 of the housing and between adjacent pairs of teeth 32 to engage the lugs 56. The lugs 52 together with the adjacent teeth form an effective retaining slot. The housing cannot move more over the teeth because of their increasing taper. After the locking clips 60 are inserted into orifices 62 in the ends of the retaining bars 52, the earth moving attachment is locked in position and is ready for use. The bolts 48 permit the cutting blade to be replaced or positioned as need be. In practice the housing is laid with its front face on the ground and the bucket teeth are introduced into it. The teeth are then rotated to a vertically down position with the teeth pressing the blade against the ground. The retaining bars and clips are attached as described previously. The earth moving attachment is removed simply by reversing the above procedure.

Figure 6:
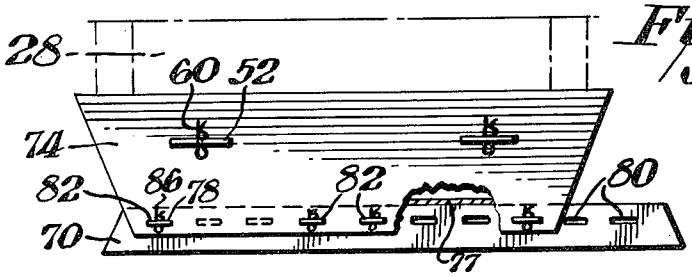
FIG. 6 is a back elevation view of an earth moving attachment constructed in accordance with another embodiment of this invention whereby the blade is secured in a slot in the lower portion of the attachment, the backhoe bucket being illustrated in phantom.
Figure 7:
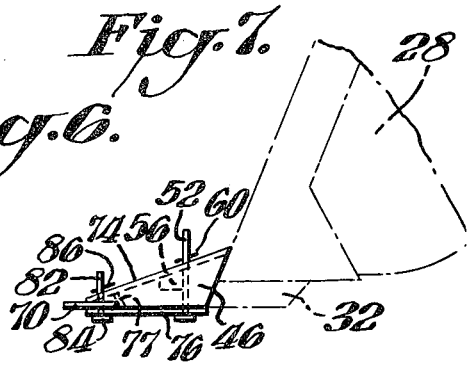
FIG. 7 is a side elevation view of the embodiment illustrated in FIG. 6.

In an alternative embodiment of this invention, the housing is formed to have a longitudinal slot formed in its lower portion to accommodate the blade and permit its sideways adjustment. This embodiment is illustrated in FIGS. 6 and 7. In this embodiment the housing 40 is formed substantially the same as described previously. The significant difference is that the normally lower portion of the housing has the front and back face plates 74 and 76 slightly spread as by a longitudinally disposed bar 77 so that the lower edges of the face plates 74 and 76 are spaced apart as illustrated in FIGS. 6 through 7, respectively. This forms a slot in the normally lower portion of the blade which will accommodate the blade 70. The bar 77 preferably is positioned generally perpendicularly to the back face plate 74 such that the blade 70 cannot pivot, particularly when in its primary use mode, i.e., pulling toward the tractor 10. The blade is introduced into the acute angle formed by the bar 77 and the front face plate 76. Aligned apertures 78 are formed in the front and back faces 74 and 76 of the housing in the normally lower portion thereof. Also, corresponding or mating apertures 80 are formed in the blade 70. Blade retaining bars 82 may then be introduced through the housing face apertures 78 and the blade apertures 80 to adjustably secure the blades in whatever sidewise position is desired in the housing. As before, the retaining bars 82 have an enlarged head portion 84 as seen most clearly in FIG. 7. The inserted ends of the lugs is apertured to accommodate retaining clips 86.

To adjust the sidewise position of the blades, it is merely necessary to disengage the spring clips 86 by withdrawing them from the retaining bars, then to withdraw the retaining bars and sliding the blade longitudinally to the desired position. Next the retaining bars 82 and clips 86 are reintroduced as previously described. When the bar is secured by the spring clip 86 the blade is ready for use. The blade sidewise adjustment greatly facilitates leveling operations close to objects such as walls and the like.

There has thus been described a relatively simple, low cost, easily attached earth moving implement for backhoe-type buckets. The attachment is secured directly to the teeth of the backhoe and thus can be very firmly and securely mounted thereto. The installation is quick and simple.

It is obvious that many embodiments may be made of this inventive concept and that many modifications may be made in the embodiments hereinbefore described. Therefore, it is to be understood that all descriptive matter therein is to be interpreted merely as illustrative, exemplary and not in a limited sense. It is intended that various modifications which might readily suggest themselves to those skilled in the art be covered, as far as the prior art permits.

What is claimed is:

1. An earth moving attachment and connection to an earth moving implement having teeth extending along substantially parallel longitudinal axes from the lower end of a bucket, said attachment and connection comprising:

a housing having a compartment with an opening and an enclosed end portion formed by two walls converging to form a blade attaching portion, said opening being of suitable size and shape to permit insertion of bucket teeth into said opening, said enclosed end portion of the compartment limiting the insertion of said teeth, and a blade secured to said blade attaching portion of said housing near the enclosed end portion of said compartment;

at least two retaining lugs each secured to adjacent sides of two adjacent longitudinally extending teeth and convergently tapered toward the bucket's lower end so that the rear ends of the lugs form an abutment in the open spacing between the adjacent teeth;

said housing having at least one aperture in a wall of said compartment for alignment with said abutment;

the attachment connection comprising a removable retaining bar passing through said compartment aperture and behind said abutment, and holding means to hold said bar substantially perpendicular to said abutment, and said compartment aperture, thereby preventing longitudinal movement of said attachment relative to said teeth.

2. An apparatus according to claim 1 wherein said retaining bar has one end enlarged to prevent its passage through said aperture in said compartment, said holding means comprising a spring clip attachable to the other end of said bar.

3. An apparatus according to claim 1 wherein said retaining bar and said aperture are rectangular in cross-section.

4. An apparatus according to claim 1 wherein said teeth of said bucket are V-shaped in longitudinal cross-section, and said compartment conforms generally to the configuration of said teeth.

5. An apparatus according to claim 1 wherein said blade is longitudinally adjustable.

6. Apparatus according to claim 5 wherein said housing has in said blade attaching portion additional apertures, said blade has apertures alignable with said additional apertures, and additional retaining bars to engage said additional apertures and said blade apertures, thereby to secure said blade to said housing.

7. An apparatus according to claim 6 wherein said blade attaching portion has a longitudinal slot to accommodate said adjustable blade.

* * * * *